US010717285B2

(12) United States Patent
Nakajima et al.

(10) Patent No.: US 10,717,285 B2
(45) Date of Patent: Jul. 21, 2020

(54) LIQUID EJECTING APPARATUS AND METHOD OF OPERATING LIQUID EJECTING APPARATUS

(71) Applicant: SEIKO EPSON CORPORATION, Tokyo (JP)

(72) Inventors: Yoshinori Nakajima, Matsumoto (JP); Takahiro Kanegae, Shiojiri (JP); Toshio Kumagai, Shiojiri (JP); Manabu Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/407,569

(22) Filed: May 9, 2019

(65) Prior Publication Data

US 2019/0344571 A1 Nov. 14, 2019

(30) Foreign Application Priority Data

May 10, 2018 (JP) ..... 2018-091174

(51) Int. Cl.

| | |
|---|---|
| ***B41J 2/175*** | (2006.01) |
| ***B41J 2/14*** | (2006.01) |
| ***B41J 29/377*** | (2006.01) |
| ***B41J 29/13*** | (2006.01) |

(52) U.S. Cl.

CPC ..... *B41J 2/175* (2013.01); *B41J 2/1433* (2013.01); *B41J 2/14201* (2013.01); *B41J 29/13* (2013.01); *B41J 29/377* (2013.01); *B41J 2002/14362* (2013.01); *B41J 2202/08* (2013.01)

(58) Field of Classification Search

CPC ..... B41J 2/14201; B41J 2/1433; B41J 2/175; B41J 29/13; B41J 29/377; B41J 2002/14362; B41J 2202/08

See application file for complete search history.

(56) References Cited

U.S. PATENT DOCUMENTS

| | | | | |
|---|---|---|---|---|
| 2005/0001868 | A1 | 1/2005 | Matsuba et al. | |
| 2007/0229611 | A1* | 10/2007 | Nagashima | B41J 2/175 347/84 |
| 2013/0120503 | A1 | 5/2013 | Shibata et al. | |
| 2015/0375511 | A1* | 12/2015 | Obata | B41J 2/175 347/31 |
| 2016/0263923 | A1* | 9/2016 | Tsubota | B41J 29/377 |

FOREIGN PATENT DOCUMENTS

| | | | |
|---|---|---|---|
| JP | 2004-009550 | A | 1/2004 |
| JP | 2004-243164 | A | 9/2004 |
| JP | 2004-322605 | A | 11/2004 |
| JP | 2013-103452 | A | 5/2013 |

* cited by examiner

*Primary Examiner* — Anh T Vo
(74) *Attorney, Agent, or Firm* — Workman Nydegger

(57) ABSTRACT

A liquid ejecting apparatus includes: a hollow housing with an aperture; a liquid ejecting head; and a supply mechanism. The liquid ejecting head has a nozzle through which liquid is to be discharged. The liquid ejecting head is supported in the housing with the nozzle exposed through the aperture. A gap is reserved between the liquid ejecting head and an inner circumferential surface of the aperture. The supply mechanism supplies dry gas to an inner space of the housing.

20 Claims, 4 Drawing Sheets

LIQUID EJECTING APPARATUS AND METHOD OF OPERATING LIQUID EJECTING APPARATUS

The present application is based on, and claims priority from JP Application Serial Number 2018-091174, filed May, 10, 2018, the disclosure of which is hereby incorporated by reference herein in its entirety.

BACKGROUND

1. Technical Field

The present disclosure relates to a technique for ejecting an ink or other liquid.

2. Related Art

Liquid ejecting heads that eject an ink or other liquid through a plurality of nozzles have been proposed to date. JP-A-2004-009550 discloses one example of such liquid ejecting heads, which includes: a flow path substrate that has pressure generation chambers communicating with nozzle apertures; piezoelectric elements that vary the inner pressures of the pressure generation chambers; and a sealing substrate that has a piezoelectric element holder defining a space in which the piezoelectric elements are accommodated.

When the disclosed liquid ejecting head is provided in the carriage, a gap is usually reserved therebetween in order to ease the replacement of the liquid ejecting head. Through this gap, however, external air may flow into the carriage and increase its inner humidity. As a result, moisture contained in the air might adhere to a drive circuit, for example, thereby damaging the liquid ejecting head.

SUMMARY

According to an aspect of the present disclosure, there is provided a liquid ejecting apparatus. This liquid ejecting apparatus includes: a hollow housing with an aperture; a liquid ejecting head; and a supply mechanism. The liquid ejecting head has a nozzle through which liquid is to be discharged. The liquid ejecting head is supported in the housing with the nozzle exposed through the aperture. A gap is reserved between the liquid ejecting head and an inner circumferential surface of the aperture. The supply mechanism supplies dry gas to an inner space of the housing.

According to another aspect of the present disclosure, there is provided a method of operating a liquid ejecting apparatus. This liquid ejecting apparatus includes: a hollow housing with an aperture; and a liquid ejecting head having a nozzle through which liquid is to be discharged. The liquid ejecting head is supported in the housing with the nozzle exposed through the aperture. A gap is reserved between the liquid ejecting head and an inner circumferential surface of the aperture. In the above method, the dry gas is supplied to an inner space of the housing in the liquid ejecting apparatus.

DESCRIPTION OF EXEMPLARY EMBODIMENTS

First Embodiment

Figure 1:
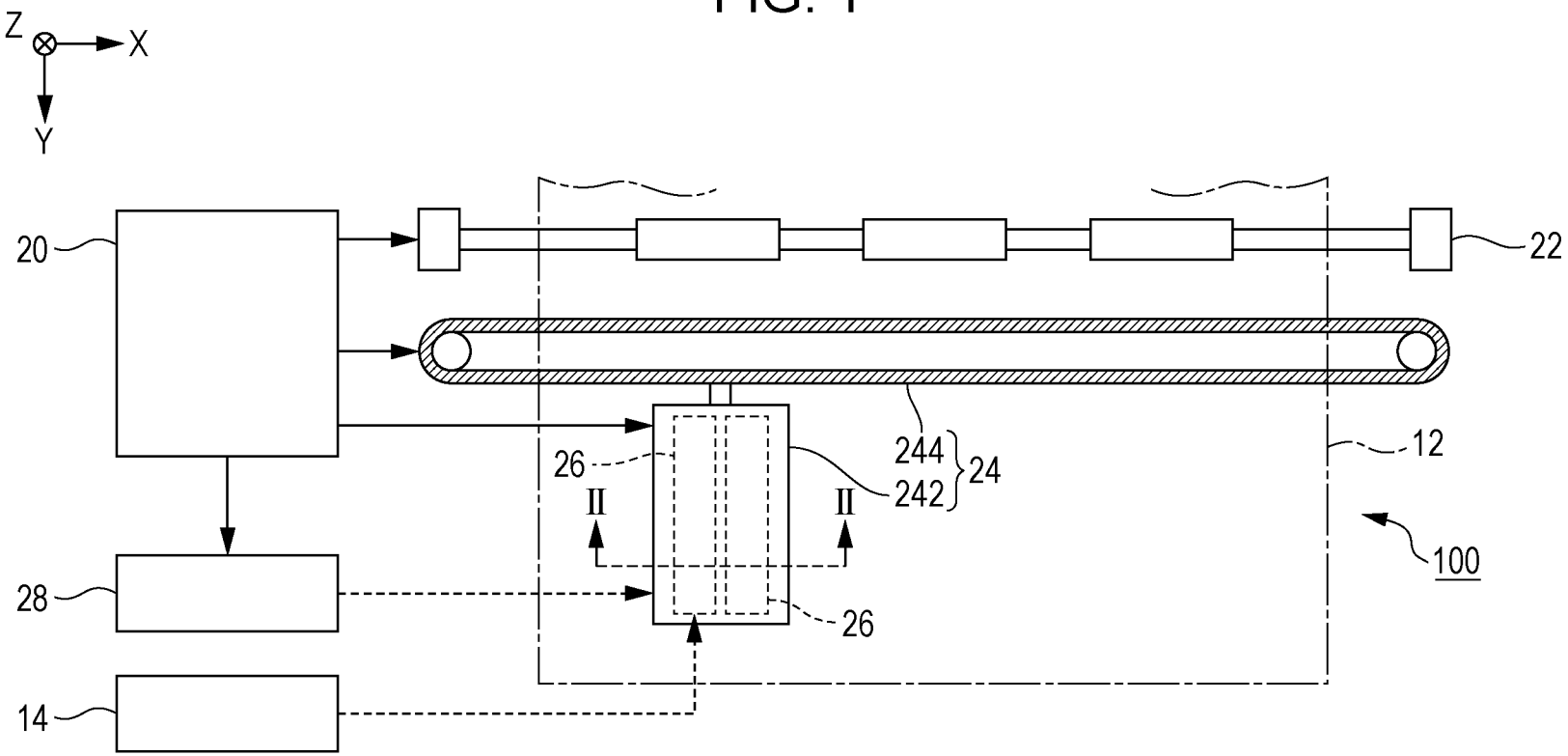
FIG. 1 is a block diagram of a configuration of a liquid ejecting apparatus according to a first embodiment of the present disclosure.

FIG. 1 is a block diagram of a configuration of a liquid ejecting apparatus 100 according to a first embodiment of the present disclosure. The liquid ejecting apparatus 100 may be an ink jet printer that discharges liquids, such as inks, onto a medium 12. The medium 12 is typically a paper sheet or alternatively may be a resin or fabric sheet or a sheet made of any other material. As illustrated in FIG. 1, the liquid ejecting apparatus 100 includes a liquid container 14 in which the inks are stored. Examples of the liquid container 14 include cartridges detachably attached to the liquid ejecting apparatus 100; pouched ink packs each made of a flexible film; and ink tanks in which the respective inks are to be filled. The inks stored in the liquid container 14 may have different colors.

As illustrated in FIG. 1, the liquid ejecting apparatus 100 further includes a control unit 20, a transport mechanism 22, a moving mechanism 24, liquid ejecting heads 26, and a supply mechanism 28, in other words, a supplier 28. The control unit 20, which includes: for example, a processing circuit such as a central processing unit (CPU) or a field programmable gate array (FPGA); and a memory circuit such as a semiconductor memory, exercises control over individual sections of the liquid ejecting apparatus 100. More specifically, for example, the control unit 20 controls the transport mechanism 22, the moving mechanism 24, and the supply mechanism 28.

The transport mechanism 22 transports the medium 12 in a Y direction, under the control of the control unit 20. In the example of FIG. 1, the liquid ejecting apparatus 100 includes two liquid ejecting heads 26; however, the liquid ejecting apparatus 100 may include any number of liquid ejecting heads 26.

The moving mechanism 24 moves the liquid ejecting heads 26 in an X direction and the opposite direction, under the control of the control unit 20. The X direction intersects the Y direction, typically at right angles, in which the medium 12 is transported. In the first embodiment, the moving mechanism 24 includes: a housing 242 having a substantially cubic shape in which the liquid ejecting heads 26 are accommodated; and a transport belt 244 fixed to the housing 242. As an example, the housing 242 may be a carriage. The plurality of liquid ejecting heads 26 may be provided alone in the housing 242, or together with the liquid container 14. The housing 242 may be formed by fixing a plurality of members together by means of bonding, welding, or fixtures such as screws.

The liquid ejecting heads 26 discharge the inks supplied from the liquid container 14 onto the medium 12 through a plurality of nozzles, or ejecting holes, under the control of the control unit 20. These nozzles are arrayed in each liquid ejecting head 26 in the Y direction. The liquid ejecting heads 26 discharge the inks onto the medium 12 in parallel with the transporting of the medium 12 and the repeated reciprocating of the housing 242 with the transport mechanism 22, thereby creating a desired image on the surface of the medium 12. Hereinafter, a direction vertical to the X-Y plane, which is the plane parallel to the surface of the medium 12, for example, is referred to as a Z direction. This Z direction corresponds to the direction in which the liquid ejecting head 26 discharges the inks. In addition, the discharge direction of the inks may correspond to either a vertical direction or a direction intersecting the vertical direction.

Figure 2:
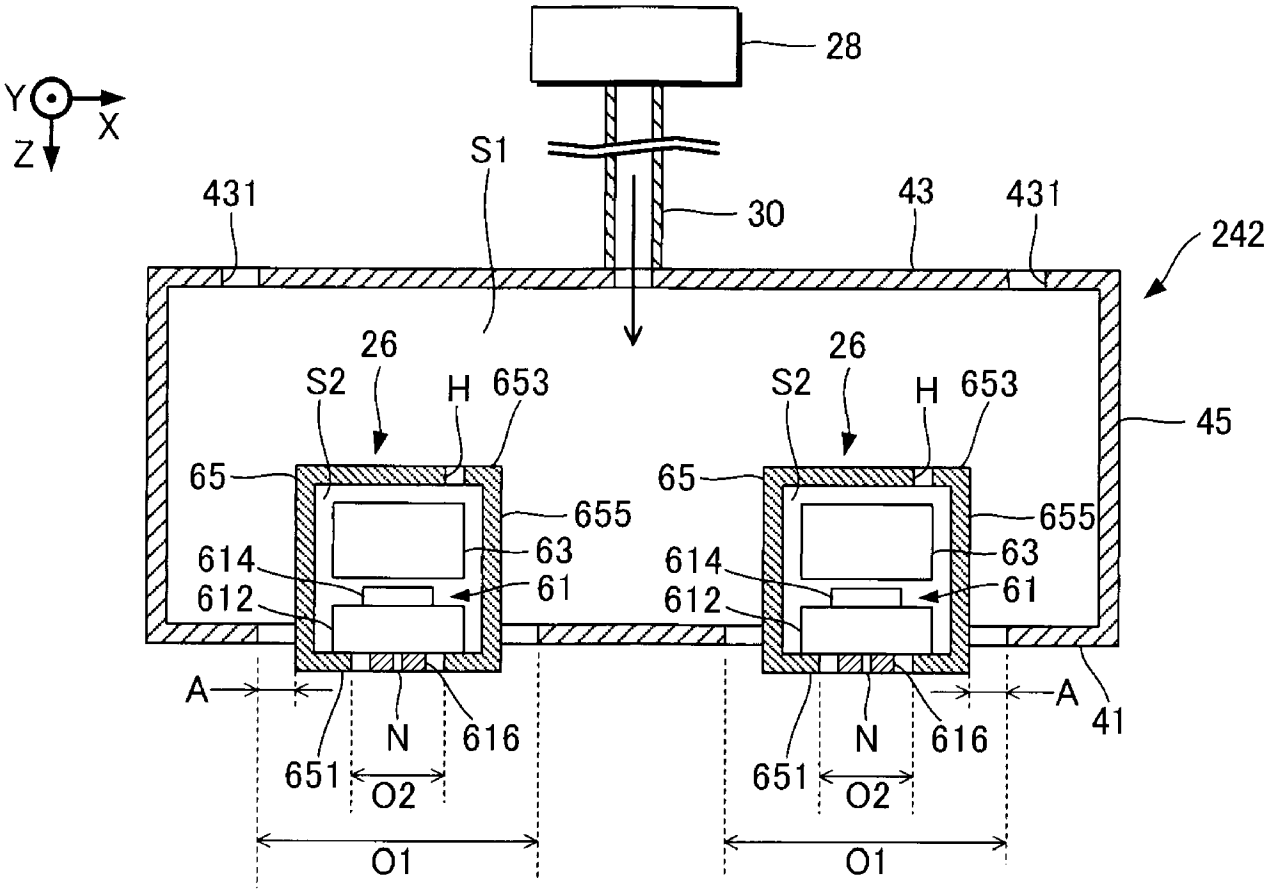
FIG. 2 is a cross-sectional view of the housing taken along the line II-II in FIG. 1.

FIG. 2 is a cross-sectional view of the housing 242 taken along the line II-II in FIG. 1. The housing 242, which has a hollow structure, includes: a bottom surface 41 and an upper surface 43 that face each other; and side surfaces 45 that couple the bottom surface 41 to the upper surface 43. The bottom surface 41 corresponds to a portion of the housing 242 which faces the medium 12. The bottom surface 41, the upper surface 43, and the side surfaces 45 of the housing 242 define an inner space S1. The liquid ejecting heads 26 are provided in the inner space S1 of the housing 242. In the first embodiment, as an example, the inner space S1 is the space surrounded by the bottom surface 41, the upper surface 43, and the side surfaces 45 of the housing 242; however, the inner space S1 may be any space inside the housing 242.

In the first embodiment, each liquid ejecting head 26 includes: a liquid ejector 61 that discharges the ink through nozzles N; a drive circuit 63 that drives the liquid ejector 61; and a container 65 in which the liquid ejector 61 and the drive circuit 63 are accommodated. The liquid ejector 61 includes a flow path section 612, a plurality of piezoelectric elements 614, and a nozzle plate 616. The flow path section 612 has a flow path for the ink, including a pressure chamber. The nozzle plate 616 has the plurality of nozzles N communicating with corresponding pressure chambers. Each piezoelectric element 614 serves as a drive element that discharges the ink from the pressure chamber. More specifically, the piezoelectric elements 614 deform in accordance with a driving signal supplied from the drive circuit 63, thereby varying the inner pressure of the pressure chamber to discharge the ink from the pressure chamber through the nozzles N.

The container 65, which has a hollow structure, includes: a bottom surface 651 and an upper surface 653 that face each other; and side surfaces 655 that couple the bottom surface 651 to the upper surface 653. The bottom surface 651 corresponds to a portion of container 65 which faces the medium 12. The bottom surface 651, the upper surface 653, and the side surfaces 655 of the container 65 define a storage space S2. In the first embodiment, as an example, the storage space S2 is the space surrounded by the bottom surface 651, the upper surface 653, and the side surfaces 655 of the container 65; however, the storage space S2 may be any space inside the container 65.

The bottom surface 651 of the container 65 is provided with an aperture O2. The liquid ejector 61 is disposed in the container 65 with the nozzle plate 616 exposed to the outside through the aperture O2. The upper surface 653 of the container 65 is provided with a connection hole H, which is an example of a connection section herein. The connection hole H is present in the inner space S1 of the housing 242 and allows the inner space S1 to be coupled to the storage space S2. Since the storage space S2 is not enclosed as described above, the inner pressure of the storage space S2 does not vary largely in response to the deforming of the piezoelectric elements 614. This configuration can decrease an error that may occur in an ejection property of the ink to be discharged through the nozzles N in response to a varying inner pressure of the storage space S2. To satisfy a recent high throughput request, an increasing number liquid ejecting heads 26 tend to be packed in a printer, and also an increasing number of nozzles tend to be arranged closely in each liquid ejecting head 26. This tendency may be a cause of inhibiting a precise, stable ink discharge operation, because the inner pressure of the storage space S2 may vary in proportion to the number of nozzles through which the ink is discharged. Furthermore, arranging many liquid ejecting heads 26 in a printer may complicate a process of replacing the liquid ejecting heads 26. An easier replacement process has been demanded accordingly.

The bottom surface 41 of the housing 242 is provided with apertures O1. As illustrated in FIG. 2, the liquid ejecting heads 26 are supported in the housing 242 with the nozzles N exposed to the outside through the apertures O1 in the housings 242. More specifically, the liquid ejecting heads 26 are provided in the housing 242 with the bottom surfaces 651 of the containers 65 positioned outside the housing 242. Further, the liquid ejecting heads 26 are supported in the housing 242 with gaps A reserved between the liquid ejecting heads 26 and the inner circumferential surfaces of the apertures O1. The gaps A are defined by the inner circumferential surfaces of the apertures O1 and the side surfaces 655 of the containers 65. This configuration involves an easier process of replacing the liquid ejecting heads 26 than that in a configuration, referred to below as a "comparative example", in which liquid ejecting heads 26 are inserted into aperture O1 with no gaps therebetween. In addition, forming the gaps A in this manner can facilitate positioning of the liquid ejecting heads 26 relative to the housing 242, especially in the X and Y direction, as compared to the comparative example. On the other hand, this configuration may have a disadvantage that will be described below. Since the inner space S1 of the housing 242 is coupled to the outside via the gaps A, external air may flow into the inner space S1 of the housing 242. The external air that has flown into the inner space S1 might affect the liquid ejectors 61 and the drive circuits 63 accommodated in the storage spaces S2, because the inner space S1 is coupled to the storage spaces S2 via the connection holes H as described above. More specifically, the external air that has flowed into the inner space S1 may increase the humidity of the housing 242, thereby increasing the risk of the liquid ejecting heads 26 (the liquid ejectors 61 and the drive circuits 63) being exposed to high humidity and damaged.

In consideration of the above disadvantage, the liquid ejecting apparatus 100 in the first embodiment employs the supply mechanism 28 to decrease a humidity Mc ($g/m^3$) of the inner space S1. The supply mechanism 28 supplies dry gas to the inner space S1 of the housing 242. The dry gas contains 4 $g/m^3$ or less, preferably 3 $g/m^3$ or less, and more preferably 1 $g/m^3$ or less of water vapor. As an example, this dry gas may be dry air. More specifically, the supply mechanism 28 includes: an air feeder, such as a pump, that feeds air; and a dehumidifier that removes moisture from the air fed by the gas feeder. The supply mechanism 28 is coupled to the housing 242 via a gas supply pipe 30 such as a tube and a connection hole, for example, formed in the upper surface 43 of the housing 242. The supply mechanism 28 supplies the dry gas to the inner space S1 of the housing 242 through the gas supply pipe 30 and the connection hole.

The upper surface 43 of the housing 242 is provided with through-holes 431. Through the through-holes 431, the inner space S1 of the housing 242 is coupled to the outside. The through-holes 431 allow external air to flow into the inner space S1 of the housing 242 and allow air in the inner space S1 to flow out to the outside of the housing 242.

The supply mechanism 28 supplies the dry gas to the inner space S1 so that the humidity Mc of the inner space S1 does not exceed a target value. In this case, the target value may be 7 g/m$^3$, preferably 4 g/m$^3$. When the temperature is approximately 25° C. and the relative humidity is approximately 30%, the target value, which is referred to below as the humidity Mc, may be 7 g/m$^3$.

In the first embodiment, the supply mechanism 28 supplies the dry gas to the inner space S1 in the state where the housing 242 is being moved by the moving mechanism 24 and in the state where the housing 242 stops. Hereinafter, the former state is referred to below as the "moving state", and the latter state is referred to below as the "stopped state". The supply mechanism 28 supplies different amounts of dry gas to the inner space S1 in the moving state and in the stopped state. Hereinafter, the amount of dry air supplied to the inner space S1 is referred to as the "supply amount". The supply mechanism 28 varies the supply amount (m$^3$/min) of the dry gas, depending on whether the housing 242 is in the moving or stopped state, under the control of the control unit 20.

The inventor has found that a humidity Md of the dry gas, a humidity Mo of the outside of the housing 242, and the humidity Mc of the inner space S1 satisfy the following equation (1) in both the moving and stopped states:

$$Fd \times Md + Fo \times Mo = (Fd + Fo) \times Mc \quad (1)$$

where Fd denotes the supply amount, referred to below as the target supply amount, which is set to maintain the humidity Mc of the inner space S1 at the target value, and Fo denotes an inflow (m$^3$/min) of the external air into the inner space S1 of the housing 242. In this case, all of the humidities (Md, Mo, and Mc) are expressed as an absolute humidity.

As can be understood from equation (1), the sum of the amount per unit time (Fd×Md) of moisture entering from the supply mechanism 28 into the inner space S1 and the amount per unit time of moisture entering from the outside of the housing 242 into the inner space S1 (Fo×Mo) is nearly equal to the amount ([Fd+Fo]×Mc) of moisture in the inner space S1 of the housing 242. Then, the target supply amount Fd of the dry gas is calculated by the following equation (2):

$$Fd = [Fo/(Mc - Md)] \times Mo + (Mc \times Fo)/(Md - Mc) \quad (2).$$

Equation (2) is obtained by deforming equation (1).

By supplying an amount of dry gas which is equal to or more than the target supply amount Fd calculated from equation (2), the humidity Mc of the inner space S1 can be set to the target value or less, such as 7 g/m$^3$ or less. The supply amount of the dry gas may be set to twice the target supply amount Fd or less.

The humidity Mc in equation (2) may be set to the target value. The humidities Md and Mo and the inflow Fo in equation (2) may be set in accordance with the specification and installation environment of the liquid ejecting apparatus 100. The humidity Md may be set to, for example, 4 g/m$^3$ or less, preferably 3 g/m$^3$ or less, and more specifically 1 g/m$^3$ or less. The humidity Mo may be set to, for example, the maximum humidity determined under the installation environment of the liquid ejecting apparatus 100. As an example, the humidity Mo may be measured with a psychrometer. The inflow Fo may be set, for example, in accordance with the areas of each gap A and each through-hole 431 and the moving speed of the housing 242. In other words, the supply amount of the dry gas may be set in accordance with the areas of each gap A and each through-hole 431 and the moving speed of the housing 242. Alternatively, the inflow Fo may be derived from an experiment. More specifically, as an example, the inflow Fo may be derived by measuring the humidities Md, Mo, and Mc and the supply amount of the dry gas under known conditions, including the areas of each gap A and each through-hole 431 and the moving speed of the housing 242 and by assigning the measured values to equation (1). In short, the inflow Fo depends on the areas of each gap A and each through-hole 431 and the moving speed of the housing 242.

When the amount of dry gas which has been set in the above manner is supplied to the inner space S1, the air that has stayed in the inner space S1 of the housing 242 flows out to the outside via the gaps A at a flow rate of 0.01 m/s or more. By regulating the flow rate of the air flowing out of the inner space S1 to the outside to 0.01 m/s or more, atomized droplets, or mist, generated as a result of discharging the inks through the nozzles N can be suppressed from entering the inner space S1 of the housing 242 through the gaps A between the housing 242 and the liquid ejecting heads 26. In this way, it is possible to further decrease the humidity Mc of the inner space S1 of the housing 242. The merit in which the droplets are suppressed from entering the inner space S1 was confirmed in the following way: a test piece having a rectangular shape of approximately 20 mm×10 mm which had been cut out from a glossy PM picture sheet produced by Seiko Epson Corporation was placed inside the housing 242, then solid printing was performed on the test piece at a density of approximately 400% of the maximum ink ejection amount for three hours, and the surface of the test piece was observed and evaluated through an optical microscope. The maximum ink ejection amount is used at least one mode in the liquid ejecting apparatus 100.

The inventor has experimentally found that by setting the flow rate at which the air flows out to the outside of the housing 242 to 0.01 m/s or more, micro droplets, especially having a diameter of 3 μm or less, which have landed on the test piece are suppressed from entering the inner space S1. Most macro droplets tend to enter the housing 242 through the gaps A and the through-holes 431 but adhere to the inner surface of the housing 242, because the movement of such macro droplets is substantially linear. As a result, macro droplets are less likely to enter the storage space S2. However, most micro droplets tend to float in the inner space S1, enter the storage space S2, and adhere to the drive circuit 63 and other electrical elements, because the movement of such micro droplets is less linear. In addition, micro droplets, the area surface of which is relatively greater than their volume, are likely to be dried and solidified to cause electrical connection failures. Suppressing such micro droplets from entering the inner space S1 thus enables the liquid ejecting apparatus 100 to operate stably.

The supply amount of external air in the stopped state can be set to be smaller than that in the moving state, because the external air is less likely to enter the inner space S1 of the housing 242 in the stopped state than in the moving state. In short, the humidity Mc of the inner space S1 can be decreased with a smaller supply amount in the stopped state than that in the moving state. For this reason, the supply mechanism 28 supplies the inner space S1 with a smaller amount of dry gas in the stopped state than that in the moving state. More specifically, the supply amount in the stopped state may be set to be larger than 1/200 and smaller than 1/20 that in the moving state.

In the first embodiment, as described above, the liquid ejecting heads 26 are supported in the housing 242, with the gaps A reserved between the liquid ejecting heads 26 and the inner circumferential surfaces of the apertures O1 of the housing 242. This configuration enables each liquid ejecting head 26 to be easily replaced with another. In addition, reserving the gaps A in this manner can easily adjust the position of the liquid ejecting heads 26 relative to the housing 242. Unfortunately, the above configuration may allow external air to enter the inner space S1 of the housing 242 through the gaps A. In this case, the inner humidity of the housing 242 might increase to damage the liquid ejecting head 26. The first embodiment, however, employs the configuration in which dry gas is supplied to the inner space S1 of the housing 242, thereby successfully decreasing the humidity Mc of the inner space S1 of the housing 242. Consequently, the configuration in the first embodiment enables easy replacement of the liquid ejecting heads 26 with a minimal risk of the liquid ejecting heads 26 being exposed to high humidity and damaged.

Some merits of the first embodiment will be described below. To effectively decrease the humidity Mc of the inner space S1, dry gas is supplied to the inner space S1. As a result, the humidity Mc of the inner space S1 is kept 7 $g/m^3$ or less. The dry gas is supplied to the inner space S1 in both the moving and stopped states. The humidity Mc of the inner space S1 thereby can be kept low in both moving and stopped states. By setting the supply amount of the dry gas in the stopped state to be smaller than that in the moving state, the liquid ejecting apparatus 100 can operate with lower electric power than a liquid ejecting apparatus in which an equal amount of dry gas is supplied in both the stopped and moving states.

In the first embodiment, the connection holes H are formed in the containers 65. This configuration exerts the above drying effect on not only the inner space S1 but also the storage spaces S2. However, the connection holes H do not necessarily have to be formed. Alternatively, by employing moisture permeable containers 65, the drying effect is exerted on not only the inner space S1 but also the storage spaces S2. These configurations can reduce the risk of the liquid ejector 61 and the drive circuit 63 accommodated in each storage space S2 being exposed to high humidity and damaged.

Second Embodiment

Next, a second embodiment of the present disclosure will be described below. Hereinafter, elements that are substantially the same as those in the foregoing first embodiment will be given identical referential characters or numerals, and detailed descriptions thereof will be skipped as appropriate.

Figure 3:
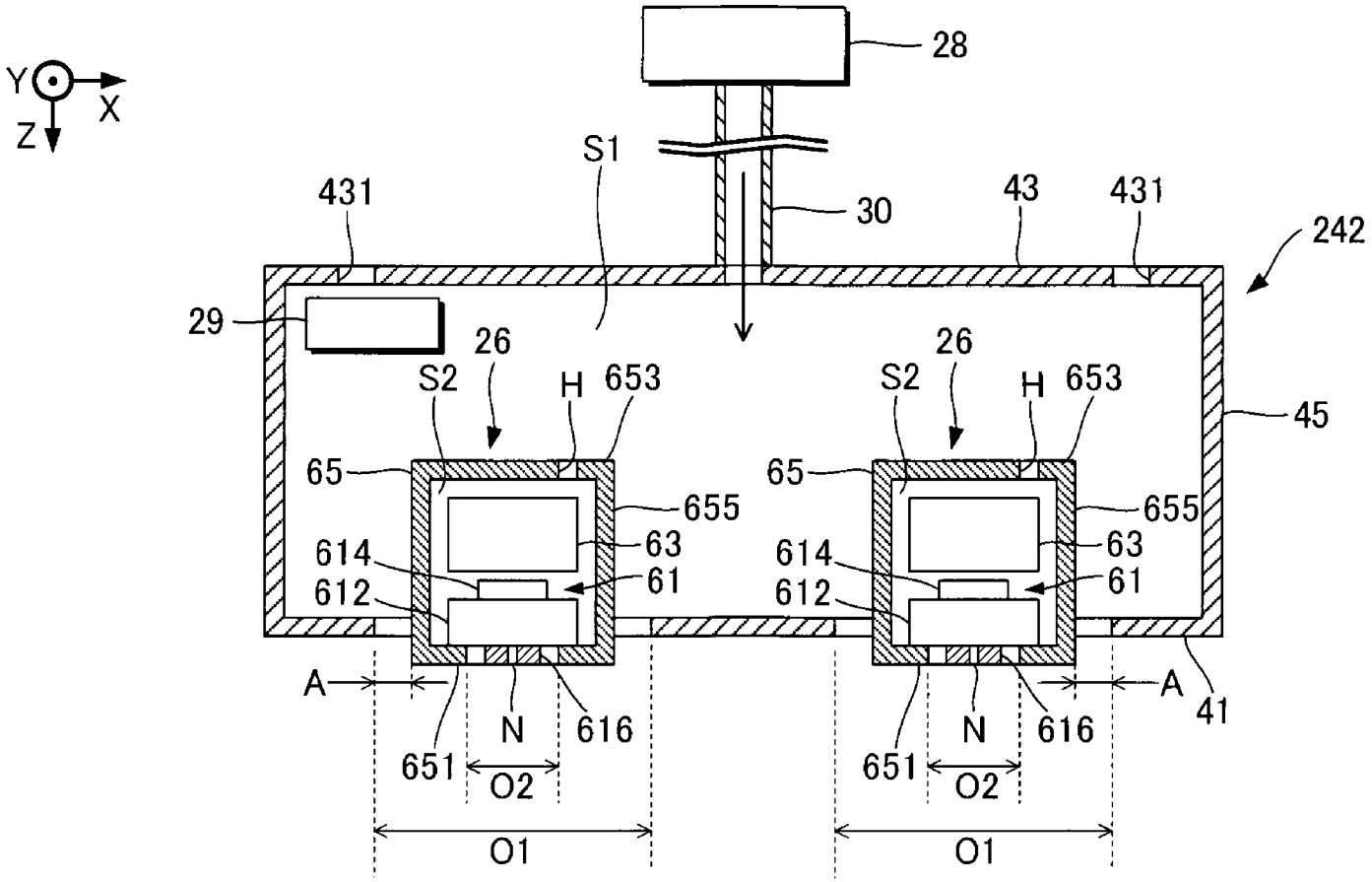
FIG. 3 is a cross-sectional view of a housing in a liquid ejecting apparatus according to a second embodiment of the present disclosure.

FIG. 3 is a cross-sectional view of a housing 242 in a liquid ejecting apparatus 100 according to the second embodiment. As illustrated in FIG. 3, a configuration of the liquid ejecting apparatus 100 in the second embodiment differs from that in the foregoing first embodiment in including a psychrometer 29. The psychrometer 29 is accommodated in an inner space S1 of the housing 242 and measures a humidity Mc of the inner space S1.

In the second embodiment, a supply mechanism 28 supplies the inner space S1 with dry gas, the amount of which is proportional to a humidity Mc measured by the psychrometer 29. In short, the supply amount of the dry gas increases with an increasing humidity Mc and decreases with a decreasing humidity Mc. The supply mechanism 28 varies the supply amount of the dry gas under the control of the control unit 20.

The second embodiment produces substantially the same effects as those in the foregoing first embodiment. In the second embodiment, the psychrometer 29 that measures the humidity Mc of the inner space S1 of the housing 242 is provided, and the supply mechanism 28 supplies the inner space S1 of the housing 242 with the dry gas, the amount of which is proportional to the measured humidity Mc. This configuration thus effectively decreases the humidity Mc of the inner space S1 of the housing 242.

Third Embodiment

In a third embodiment, a supply mechanism 28 supplies an inner space S1 with dry gas, the temperature of which is set to be lower than that of air external to a housing 242. As an example, a thermometer that measures a temperature of the air external to the housing 242 is provided outside the housing 242. The supply mechanism 28 includes, in addition to the gas feeder and the dehumidifier in the foregoing first embodiment, a cooling mechanism that cools air fed by the gas feeder. The cooling mechanism varies the temperature of the dry gas under the control of the control unit 20.

The third embodiment produces substantially the same effects as those in the foregoing first embodiment. In the third embodiment, the supply mechanism 28 supplies the inner space S1 of the housing 242 with the dry gas, the temperature of which is set to be lower than that of the air external to the housing 242, thereby successfully decreasing temperature of the inner space S1 of the housing 242. In short, the supply mechanism 28 serves as a mechanism that air-cools liquid ejecting heads 26. This configuration can reduce the risk of liquid ejecting heads 26 being exposed to high temperature and damaged. It should be noted that the configurations in the third embodiment and the foregoing second embodiment may be employed in combination.

Fourth Embodiment

Figure 4:
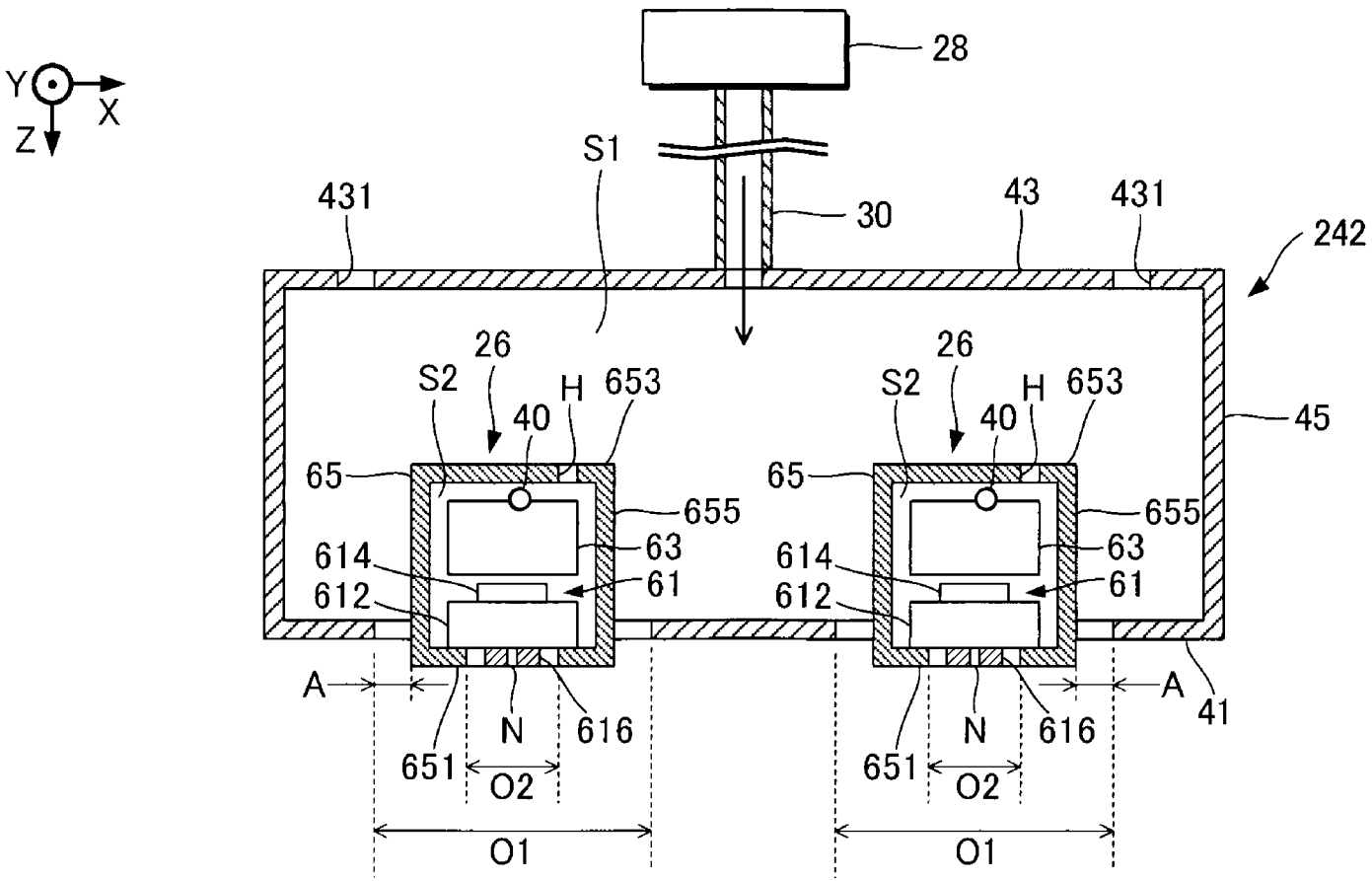
FIG. 4 is a cross-sectional view of a housing in a liquid ejecting apparatus according to a fourth embodiment of the present disclosure.

FIG. 4 is a cross-sectional view of a housing 242 in a liquid ejecting apparatus 100 according to a fourth embodiment of the present disclosure. The liquid ejecting apparatus 100 differs from the liquid ejecting apparatus 100 in the foregoing first embodiment in including a drying agent 40. As illustrated in FIG. 4, the drying agent 40 is disposed in storage spaces S2 of containers 65. As an example, the drying agent 40 is preferably a substance such as silica gel that physically absorbs matter. As an alternative example, the drying agent 40 may be a substance such as slacked lime that chemically absorbs matter.

The fourth embodiment produces substantially the same effects as those in the foregoing first embodiment. In the fourth embodiment, the drying agent 40 is disposed in the storage spaces S2. This configuration, even if a supply mechanism 28 fails to operate, can reduce the risk of liquid ejecting heads 26 being exposed to high temperature and damaged. It should be noted that the configuration in the fourth embodiment may be combined with any of those of the foregoing first to third embodiments. Moisture flowing into each storage space S2 in which the drying agent 40 is disposed is smaller in amount than that flowing into the inner space S1 of the housing 242. As an example, this configuration thus enables a small amount of low-cost drying agent 40 to be used compared to a configuration in which a drying agent is disposed in the inner space S1. Consequently, the configuration in the fourth embodiment effectively reduces the risk of the liquid ejecting heads 26 being exposed to high temperature and damaged.

Modifications

The foregoing first to fourth embodiments can be modified in various ways. Some modifications of the first to fourth embodiments will be described below. It should be noted that two or more of such modifications may be selected and combined together as appropriate unless the selected modifications are inconsistent.

(1) In a liquid ejecting apparatus 100 according to the foregoing first to fourth embodiments, a supply mechanism 28 varies the supply amount of dry gas under the control of a control unit 20; however, the supply mechanism 28 does not necessarily have to vary the supply amount of dry gas under the control of the control unit 20. As an alternative example, the supply mechanism 28 may vary the supply amount of dry gas in accordance with an instruction that a user has manually entered in an input device.

(2) In a liquid ejecting apparatus 100 according to the foregoing first to fourth embodiments, a supply mechanism 28 supplies dry air as a dry gas; however, the dry gas does not necessarily have to be dry air. As an alternative example, the dry gas may be an inert gas such as nitrogen. In this case, the configuration of the supply mechanism 28 may be modified as appropriate in accordance with the type of the dry gas.

(3) In a liquid ejecting apparatus 100 according to the foregoing first to fourth embodiments, the supply amount of dry gas is set based on a target supply amount Fd calculated from equation (2); however, the supply amount may be set in a different way. As an alternative example, the supply amount may be set based on a specification of liquid ejecting heads 26, such as a moving speed of a housing 242 or the area of each gap A, and an installation environment of the liquid ejecting apparatus 100, such as surrounding temperature or humidity. The supply amount of dry gas may be set to any given value, provided that the supplied dry gas can decrease a humidity Mc of an inner space S1.

(4) In a liquid ejecting apparatus 100 according to the foregoing first to fourth embodiments, a flow rate of gas flowing out of an inner space S1 of a housing 242 to the outside through gaps A is set to 0.01 m/s or more; however, the flow rate may be set to any other value. Nevertheless, the supply amount of gas is preferably regulated so that the flow rate of the gas becomes 0.01 m/s or more, because droplets generated as a result of discharging liquid is appropriately suppressed from flowing into the inner space S1.

(5) In a liquid ejecting apparatus 100 according to the foregoing first to fourth embodiments, dry gas is supplied to an inner space S1 of a housing 242 so that a humidity Mc of the inner space S1 does not exceed 7 $g/m^3$ that has been set as a target value; however, the target value may be any other value, provided that it is possible to decrease the humidity Mc of the inner space S1.

(6) In a liquid ejecting apparatus 100 according to the foregoing first to fourth embodiments, the supply amount of dry gas is regulated in order to prevent a humidity Mc of an inner space S1 of a housing 242 from exceeding a target value; however, any other method may be employed to prevent the humidity Mc from exceeding the target value. As an alternative example, a temperature and humidity of the dry gas may be regulated.

(7) In a liquid ejecting apparatus 100 according to the foregoing first to fourth embodiments, different amounts of dry gas are supplied to the inner space S1 both in a moving state and in a stopped state. However, as an alternative example, an equal amount of dry gas may be supplied to the inner space S1 in the moving and stopped states, or the supply of the dry gas may be stopped in the stopped state.

(8) In a liquid ejecting apparatus 100 according to the foregoing first to fourth embodiments, a control unit 20 causes a supply mechanism 28 to vary the supply amount of dry gas, depending on whether a housing 242 is in a moving state or in a stopped state; however, the control unit 20 may control the supply amount of dry gas in a different way, examples of which will be described below.

As a gap A between a liquid ejecting head 26 and the inner circumferential surface of an aperture O1 in a housing 242 is enlarged, an inflow Fo of external air into an inner space S1 increases, thereby making a humidity Mc of the inner space S1 more likely to increase. In consideration of this tendency, the control unit 20 may cause a supply mechanism 28 to supply the inner space S1 with dry gas, the amount of which is proportional to the area of the gap A. For example, if liquid ejecting heads 26 are attachable to the housing 242 through apertures O1, the total area of gaps A can depend on the number of liquid ejecting heads 26 inserted into the apertures O1. In this case, apertures O1 into which liquid ejecting heads 26 are not inserted may be covered with lib members, for example.

In consideration with the above, the control unit 20 preferably controls the supply amount of dry gas in accordance with, for example, the number of liquid ejecting heads 26 attached to the housing 242. As an example, the control unit 20 may cause the air supply mechanism 28 to supply a larger amount of dry gas as a larger number of liquid ejecting heads 26 are attached to the housing 242. In other words, the control unit 20 may cause the air supply mechanism 28 to supply a larger amount of dry gas as each gap A becomes greater to make the humidity Mc of the inner space S1 more likely to increase. The number of liquid ejecting heads 26 attached to the housing 242 may be determined in accordance with, for example, an instruction that a user has entered in an input device. With this configuration, the control unit 20 causes the supply mechanism 28 to supply the inner space S1 of the housing 242 with dry gas, the amount of which is proportional to the total area of gaps A, thereby effectively decreasing the humidity Mc of the inner space S1 of the housing 242.

As a moving mechanism 24 increases a moving speed of the housing 242, inflow Fo of external air into the inner space S1 increases, thereby making the humidity Mc of the inner space S1 more likely to increase. In consideration of this tendency, the control unit 20 may cause the supply mechanism 28 to supply the inner space S1 with dry gas, the amount of which is proportional to, if the housing 242 moves at a variable speed, the moving speed of the housing 242. For example, the control unit 20 may cause the moving mechanism 24 to move housing 242 at a variable speed. Then, the control unit 20 may increase the supply amount of dry gas as the moving speed of the housing 242 increases. In other words, as the housing 242 moves at a higher speed to make the humidity Mc of the inner space S1 more likely to increase, the control unit 20 may cause the supply mechanism 28 to supply a larger amount of dry gas. With this configuration, the control unit 20 causes the supply mechanism 28 to supply the inner space S1 of the housing 242 with dry gas, the amount of which is proportional to the moving speed of the housing 242, thereby effectively decreasing the humidity Mc of the inner space S1 of the housing 242.

(9) In a liquid ejecting apparatus 100 according to the foregoing first to fourth embodiments, connection holes H are formed in upper surfaces 653 of containers 65. However, each connection hole H may be formed in any other location, provided that containers 65 are formed in an inner space S1.

(10) In a liquid ejecting apparatus 100 according to the foregoing first to fourth embodiments, connection holes H are formed in the containers 65. In this case, each connection hole H may be covered with a gas-permeable sealant made of a thin gas-permeable film, for example. Regardless of whether each connection hole H is covered with the gas-permeable sealant, each connection hole H may be comprehensively interpreted as a connection section by which a corresponding storage space S2 is coupled to an inner space S1.

(11) In a liquid ejecting apparatus 100 according to the foregoing first to fourth embodiments, containers 65 each of which accommodate a liquid ejector 61 and a drive circuit 63 are provided in respective liquid ejecting heads 26. However, the containers 65 do not necessarily have to be provided in the liquid ejecting heads 26.

(12) In a liquid ejecting apparatus 100 according to the foregoing second embodiment, a configuration may also be employed in which dry gas is supplied to an inner space S1 when a humidity Mc measured by a psychrometer 29 exceeds a target value.

(13) In a liquid ejecting apparatus 100 according to the foregoing first to fourth embodiments, drive elements that discharge liquid, such as inks, from pressure chambers through nozzles N are not limited to piezoelectric elements. As an alternative example, the drive elements may be heater elements that vary inner pressures of the pressure chambers by heating the pressure chambers to generate bubbles therein. As understood from this example, each drive element may be comprehensively interpreted as an element that discharges liquid from the pressure chamber through the nozzles N, namely, in a typical case, an element that applies pressure to the pressure chamber. In addition, any given operational scheme, such as a piezoelectric or thermal scheme, and configuration may be employed.

(14) A liquid ejecting apparatus 100 according to the foregoing first to fourth embodiments employs a serial type in which housings 242 with liquid ejecting heads 26 reciprocate. However, the present disclosure is also applicable to line type liquid ejecting apparatuses in which a plurality of nozzles N are arranged opposite the entire width of a medium 12.

(15) A liquid ejecting apparatus 100 according to the foregoing first to fourth embodiments may be apparatuses dedicated to the printing purpose, as well as facsimile machines, copy machines, and other similar apparatuses. The purpose of using a liquid ejecting apparatus according to an aspect of the present disclosure is not limited to printing. As some examples, a liquid ejecting apparatus that discharges a colored solution may be used as a manufacturing apparatus that fabricates color filters for liquid crystal panels and other display devices. A liquid ejecting apparatus that discharges a solution to conductive materials may be used a manufacturing apparatus that fabricates wires and electrodes for wiring substrates. A liquid ejecting apparatus that discharges a solution to organic matter of living bodies may be used as a manufacturing apparatus that fabricates biochips, for example.

What is claimed is:

1. A liquid ejecting apparatus comprising:

a housing having a hollow structure therein and an aperture thereon;

a liquid ejecting head having a nozzle for discharging liquid, the liquid ejecting head being supported in the housing exposing the nozzle through the aperture with a gap kept between the liquid ejecting head and an inner circumferential surface of the aperture; and a supplier configured to supply dry gas to an inner space of the housing.

2. The liquid ejecting apparatus according to claim 1, wherein a gas flows out of the inner space to an outside of the housing through the gap at a flow rate of 0.01 m/s or more.

3. The liquid ejecting apparatus according to claim 1, wherein the supplier is configured to set a humidity of the inner space to 7 $g/m^3$ or less by supplying the dry gas to the inner space.

4. The liquid ejecting apparatus according to claim 1, further comprising a psychrometer that measures a humidity of the inner space, wherein the supplier is configured to supply the inner space with the dry gas, an amount of which is proportional to a measurement result of the psychrometer.

5. The liquid ejecting apparatus according to claim 1, wherein the supplier is configured to supply the inner space with the dry gas, an amount of which is proportional to an area of the gap.

6. The liquid ejecting apparatus according to claim 1, further comprising a moving mechanism that moves the housing, wherein the supplier is configured to supply the inner space with the dry gas, an amount of which is proportional to a moving speed of the housing.

7. The liquid ejecting apparatus according to claim 1, further comprising a moving mechanism configured to move the housing, wherein the supplier is configured to supply the dry gas to the inner space in a state where the housing is moving and in a state where the housing stops.

8. The liquid ejecting apparatus according to claim 7, wherein an amount of the dry gas supplied in the state where the housing stops is smaller than an amount of the dry gas supplied in the state where the housing is moving.

9. The liquid ejecting apparatus according to claim 1, wherein the supplier is configured to supply the inner space with the dry gas, a temperature of which is set to be lower than a temperature of air external to the housing.

10. The liquid ejecting apparatus according to claim 1, wherein the liquid ejecting head includes a liquid ejector that discharges the liquid through the nozzle, a drive circuit that drives the liquid ejector, and a container having a storage space in which the liquid ejector and the drive circuit are accommodated, wherein a connection section by which the storage space is coupled to the inner space is formed in the container within the inner space.

11. The liquid ejecting apparatus according to claim 10, further comprising a drying agent disposed in the storage space.

12. A method of operating a liquid ejecting apparatus, the method comprising:

supplying dry gas to an inner space of the housing supporting a liquid ejecting head allowing the gas to emit from a gap kept between an aperture of the housing and the head, the aperture exposing a nozzle of the head from the aperture.

13. The method according to claim 12, wherein the supplying of the dry gas to the inner space of the housing is performed while the liquid is being discharged through the nozzle.

14. The method according to claim 12, wherein the supplying of the dry gas to the inner space is performed so that a flow rate of a gas flowing out of the inner space to an outside of the housing through the gap becomes 0.01 m/s or more.

15. The method according to claim 12, wherein the supplying of the dry gas to the inner space is performed so that a humidity of the inner space becomes 7 $g/m^3$ or less.

16. The method according to claim 12, wherein the supplying of the dry gas to the inner space is performed with an amount of the dry gas being proportional to a humidity of the inner space.

17. The method according to claim 12, wherein the supplying of the dry gas to the inner space is performed with an amount of the dry gas being proportional to an area of the gap.

18. The method according to claim 12, wherein the supplying of the dry gas to the inner space is performed with an amount of the dry gas being proportional to a moving speed of the housing.

19. The method according to claim 12, wherein the supplying of the dry gas to the inner space is performed in a state where the housing is moving and in a state where the housing stops.

20. The method according to claim 19, wherein an amount of the dry gas supplied in the state where the housing stops is smaller than an amount of the dry gas supplied in the state where the housing is moving.

* * * * *